US005772491A

United States Patent [19]

Watkins

[11] Patent Number: 5,772,491

[45] Date of Patent: Jun. 30, 1998

[54] CONTROLLABLE CONFETTI LAUNCHER

[76] Inventor: James O. Watkins, 14920 Mt. Hebo Rd., Poolesville, Md. 20837

[21] Appl. No.: 566,147

[22] Filed: Dec. 1, 1995

Related U.S. Application Data

[63] Continuation-in-part of Ser. No. 490,406, Jun. 14, 1995, Pat. No. 5,634,840, and Ser. No. 111,608, Aug. 25, 1993, Pat. No. 5,529,527.

[51] Int. Cl.[6] ..... A63H 37/00

[52] U.S. Cl. ..... 446/475

[58] Field of Search ..... 446/475, 176; 124/74, 73, 83, 84; 222/5, 4, 402.25; 137/240, 614.19, 224; 251/149.6, 148; 116/142 FP, 112; 141/47, 19, 95, 98

[56] References Cited

U.S. PATENT DOCUMENTS

| | | | |
|---|---|---|---|
| 3,227,148 | 1/1966 | Spack | 124/74 X |
| 3,382,859 | 5/1968 | Myers | 124/74 |
| 3,773,360 | 11/1973 | Timbers | 285/307 |
| 4,934,543 | 6/1990 | Schmidt | 222/5 X |
| 5,149,290 | 9/1992 | Reveen | 124/74 X |
| 5,634,840 | 6/1997 | Watkins | 446/475 |

*Primary Examiner*—Mickey Yu
*Attorney, Agent, or Firm*—Ronald B. Sherer

[57] ABSTRACT

A hand-held confetti launcher is disclosed of a size and shape such as to be held in and operated by one hand, and which includes readily separable connectors for rapidly removing an empty barrel and replacing it with another barrel pre-filled with confetti.

9 Claims, 2 Drawing Sheets

FIG. 3
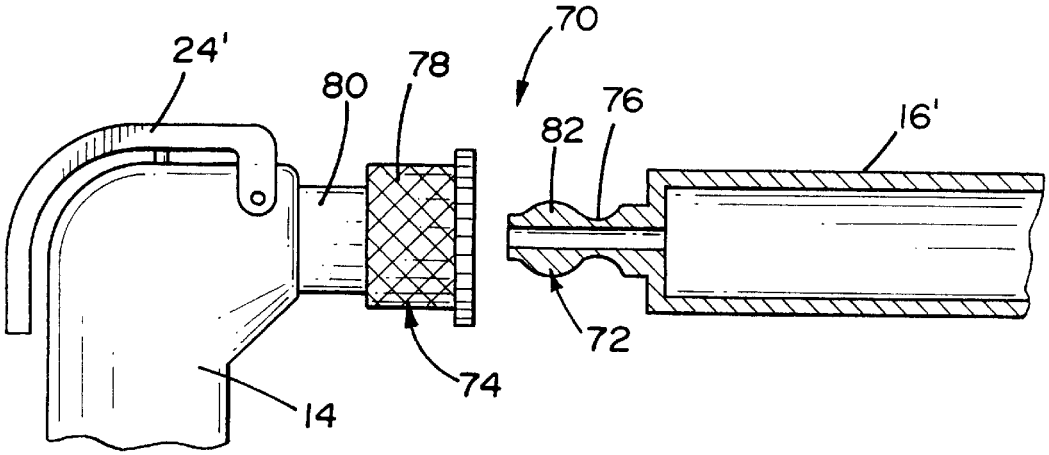
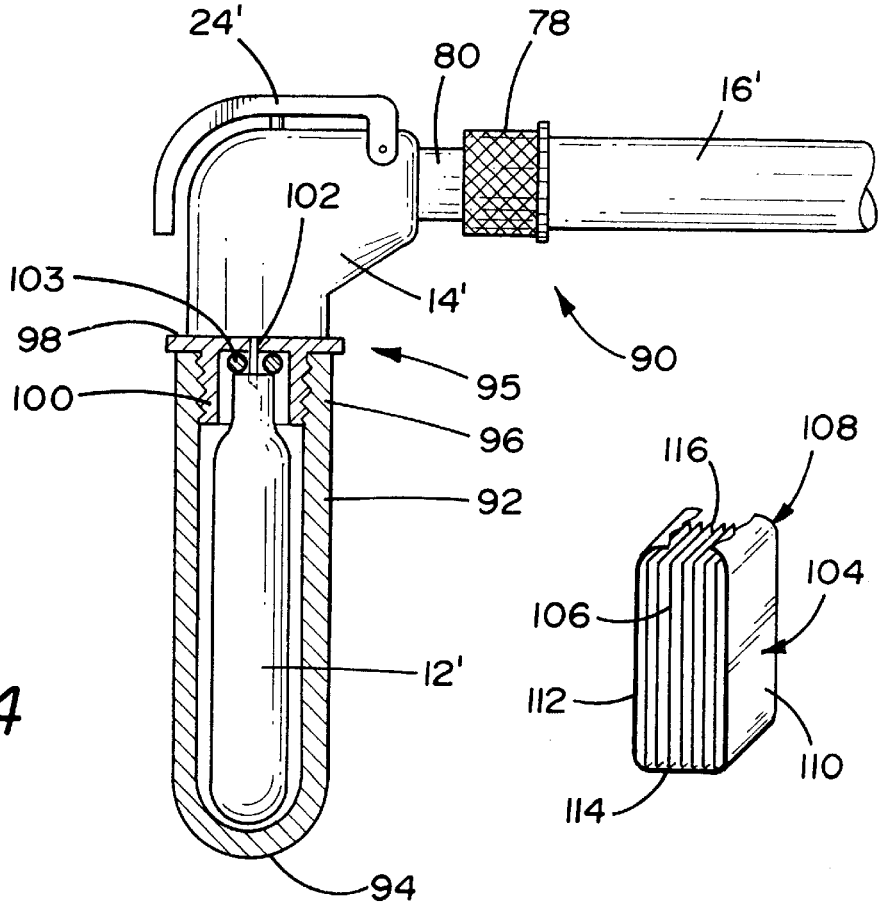
FIG. 4
FIG. 5

CONTROLLABLE CONFETTI LAUNCHER

This Application is a Continuation-In-Part of Application Ser. No. 08/490,406 filed 14 Jun. 1995, now U.S. Pat. No. 5,634,840, and application Ser. No. 08/111,608 filed 25 Aug. 1993, now U.S. Pat. No. 5,529,527, which patents are hereby incorporated by reference.

FIELD OF THE INVENTION

This invention relates to a compressed gas system for launching confetti, and more particularly to a small, compact and safe confetti launcher which may be held in one hand and used by both professionals and non-professionals.

BACKGROUND

The use of so-called "cannons" by professionals to shoot confetti at amusement parks, concerts, and other events has long been enthusiastically enjoyed by audiences. Such cannons are powered by compressed gas tanks, or compressed gas cylinders, which operate at pressures in the order of 600–800 p.s.i. Such cannons are usually in the order of several feet long, with a wall thickness in the order of ¼ inch and are composed of PVC or metal tubing having an internal diameter in the order of 1.25 inches or more. Accordingly, such systems are expensive, bulky and are not safe in the hands of non-professionals. In addition, cannons which are designed for use with $CO_2$ cartridges, such as those disclosed in U.S. Pat. Nos. 2,756,737, 5,015,211 and 5,149,290 operate on the basis of puncturing the seal of the $CO_2$ cartridge such that the entire cartridge is suddenly emptied of the high pressure gas in one, uncontrolled and uncontrollable discharge. Such operation not only has obvious safety hazards, particularly when attempted by non-professionals, but it is also expensive in that each $CO_2$ cartridge can only provide one shot of confetti from the cannon. Thus, it is not possible to shoot a plurality of small loads of confetti with a single cartridge as is desirable for the professional on stage, or for the non-professional at home parties and other festive occasions.

SUMMARY

The present invention overcomes all of the above-indicated problems and hazards of prior art confetti cannons by providing a compact, lightweight, hand-held confetti launcher which includes a readily operated on-off valve for controlling the flow of relatively low pressure gas into a confetti-filled barrel from a relatively high pressure cylinder, such as a $CO_2$ cartridge, and which confetti launcher can be held in and operated by only one hand. These and other objects and advantages will become apparent from the following description of several preferred embodiments of the invention as illustrated in the following drawings.

BRIEF DESCRIPTION OF THE DRAWINGS

FIG. 3 is a simplified elevational view, partly in cross-section, of a second embodiment of the present invention; and FIG. 4 is a simplified elevational view, partly in cross-section, of a third embodiment of the present invention.

DETAILED DESCRIPTION

Figure 1:
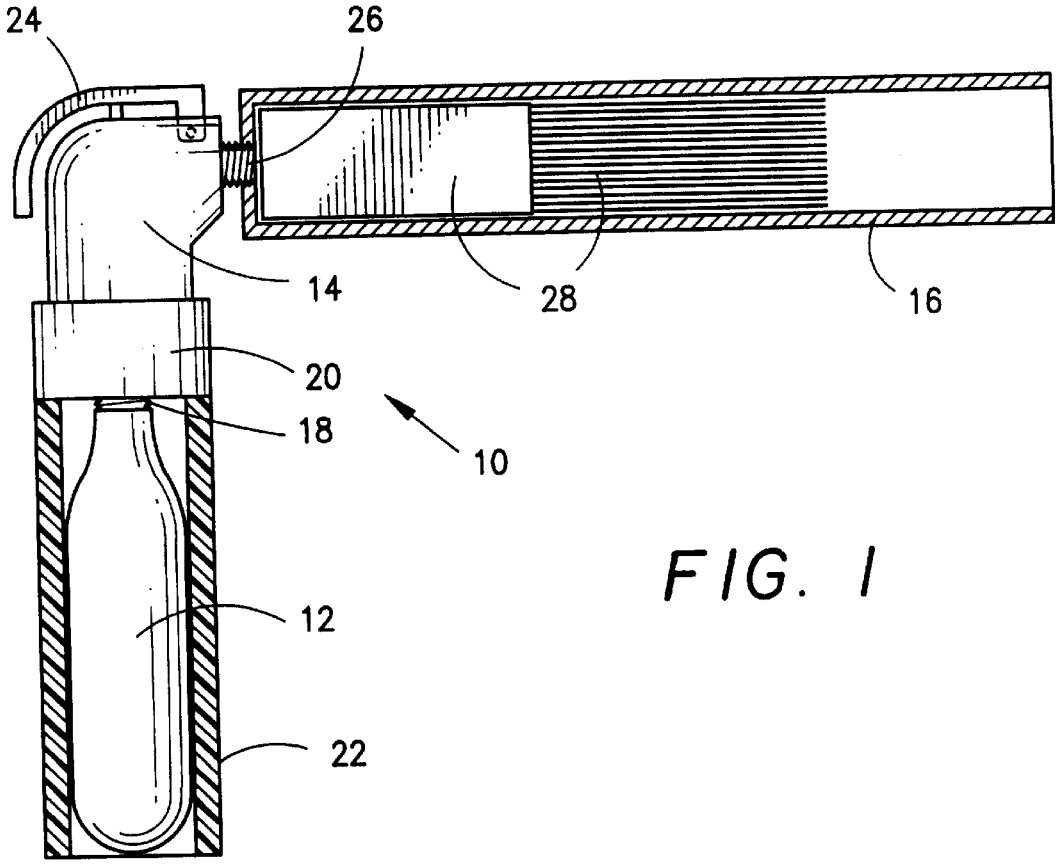
FIG. 1 is a simplified elevational view of one embodiment of the confetti launcher of the present invention.

Referring to FIG. 1, numeral 10 indicates one embodiment of the present invention wherein the confetti launcher comprises a compressed gas cylinder 12, a valve-trigger assembly 14 and a confetti-filled barrel 16. Cylinder 12 may be a commercially available $CO_2$ cartridge. Such cartridges are available with threaded neck portions 18 in 16 gram and 38 gram sizes. Both of these are of a size such as to be conveniently held in one hand, and threaded neck portion 18 may be simply threaded into base 20 of the valve-trigger assembly 14. While the cylinder may be grasped directly by hand, it is preferred that a thermally insulating sleeve 22 be provided around the cylinder since the cylinder may become cool as the compressed and/or liquefied gas is discharged.

Figure 2:
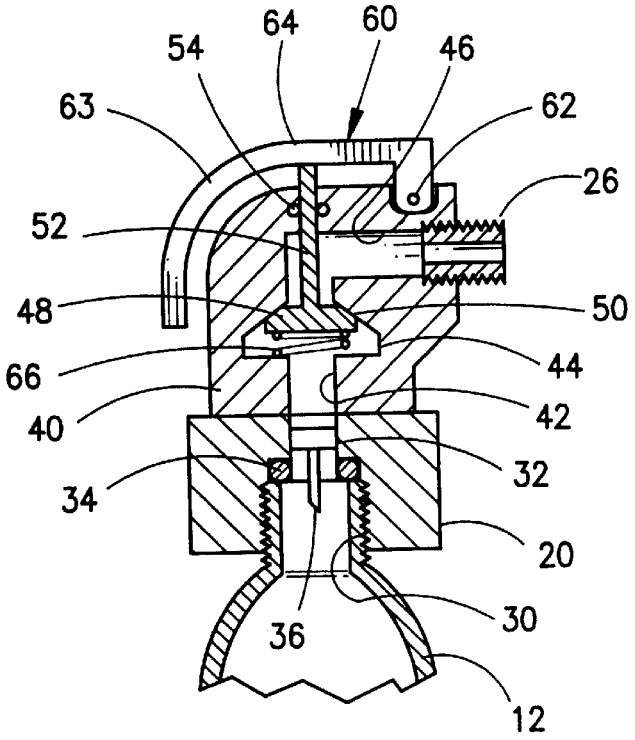
FIG. 2 is an enlarged, simplified view, partly in cross-section, showing the details of one possible valve-and-trigger assembly for use in the present invention.

While the details of the valve-trigger assembly 14 will be described hereinafter with reference to FIG. 2, it will be understood that assembly 14 contains a manually operable, on-off, pressure-reduction valve which is normally closed, and which may be opened and closed by actuating a trigger means such as lever 24. The downstream, low pressure side of the valve is connected through an internal passage to a threaded fitting 26 which connects the internal passage to the internal end of confetti barrel 16. Preferably, fitting 26 is permanently secured to the valve body by a retaining pin (not shown) or glued, or otherwise secured such that the fitting remains connected to the valve body while the confetti barrel 16 may be readily removed from the fitting.

Confetti barrel 16 may be supplied to the user prefilled with confetti 28, and the barrel may be composed of thin-walled plastic, flexible vinyl or cardboard so as to be discarded after each use and replaced by another prefilled barrel. Alternatively, the barrel may be composed of more durable material such as PVC tubing, and it may be loaded and reloaded by the user. In the preferred embodiment, such loading is easily accomplished by the user by simply inserting one or more stacks or bundles 28 of elongated, tetragonal-shaped confetti. Such confetti is known under the trademark FLUTTER FETTI® confetti and is described more fully in U.S. Pat. Nos. 5,352,148 and 5,403,225, which patents are hereby incorporated by reference. One or more stacks or bundles of FLUTTER FETTI confetti may be quickly inserted into the barrel and, when more than one unwrapped stack or wrapped bundle of confetti 28 is contained along the length of the barrel, it is preferred that the layers of confetti in the stacks or bundles be oriented at an angle with respect to each other as more fully described in U.S. Pat. 5,403,225. In addition, the confetti launcher of the present invention may also be used to launch small confetti streamers; ie, rolls of tissue paper or plastic film as are known per se. Accordingly, the term "confetti" as used herein is intended to include conventional confetti, FLUTTER FETTI confetti and confetti streamers.

While barrel 16 may be of a wide range of sizes, for non-professional use it has been discovered that a preferred range of internal diameters is between 0.5 and 1.0 inches. The length of the barrel should be between 3 and 12 inches, and more preferably between 3 and 7 inches. Within these ranges, the barrel may be loaded with between one and four unwrapped stacks or wrapped bundles of FLUTTER FETTI confetti, and a single $CO_2$ cartridge will be sufficient to launch two to three such loads of confetti.

The details of the valve-trigger assembly 14 will now be described with reference to FIG. 2 which is a simplified, schematic illustration of one example of a valve suitable for use in the present invention. Assembly 14 includes a base portion 20 which may be composed of metal and is provided with a threaded bore 30 which receives the threaded neck portion 18 of the $CO_2$ cartridge. Bore 30 extends into a reduced-diameter counter-bore 32 and a seal, such as one or more 0-rings 34, is provided to seal against the end of the cartridge. Counter-bore 32 supports a hollow puncturing needle 36 which may be threaded into the bore or be supported by a web in the counter-bore. Of course, other arrangements of these elements are possible; however, it is important that the seal 34 and the tip of needle 36 are positioned such that, as the cartridge is screwed into base 20, the seal engages the end of the cartridge before the tip of the needle punctures the high pressure seal on the cartridge so that high pressure gas is not lost in making the connection.

Valve-trigger assembly 14 further includes a valve body portion 40 which may be made of plastic. Valve body 40 includes a high pressure fluid passage 42 in communication with counter-bore 32, and high pressure passage 42 opens into a valve chamber 44. Valve chamber 44 is connected to a downstream, lower pressure passage 46, which leads to fitting 26 previously described, and a valve head 48 is interposed between valve chamber 44 and lower pressure passage 46; valve head 48 being seated against a valve seat 50 formed in the valve body. Valve head 48 is illustrated as being connected to, or integral with, a valve stem 52 which extends through the valve body. Valve stem 52 may be provided with one or more fluid seals 54 which may be in the form of 0-rings as shown, or other types of known seals, and it will be understood that the valve head and stem may be separate elements, and that valve head may be a ball or other shape of valve head. In addition to operating as an on-off valve for the flow of gas therethrough, it is to be understood that the size of passages 42, 46 and the size of the passage between valve head 48 and seat 50, when the valve is open, are selected to be such that a substantial pressure drop is caused to occur in flowing through the valve. Thus, the valve is a pressure reduction valve, as well as an on-off valve, such that only low and safe pressures occur in barrel 16. For example, it is preferred that the maximum pressure in the barrel be not greater than one-half the internal pressure in the cylinder, and preferably not more than 100 p.s.i.

Valve-trigger assembly 14 further includes a valve actuator or trigger 60. Trigger 60 is shown in the form of a lever 24 pivoted to the valve body by a pin 62 and includes an arm portion 64 which engages the end of valve stem 52. Therefore, valve head 48 may be moved downwardly, as viewed in FIG. 2, away from valve seat 50 when the curved portion 63 of trigger arm 64 is momentarily pressed downwardly by the thumb of the user's hand which grasps sleeve 22 surrounding cylinder 12. This momentary opening of the valve permits high pressure gas from passage 42 to flow into valve chamber 44 where the pressure is greatly reduced in flowing through the highly restricted area between valve head 48 and valve seat 50. Thus, relatively low pressure gas flows through low pressure passage 46 and fitting 26 into confetti barrel 16 which makes the present confetti launcher very safe for use by professionals and non-professionals alike. However, this momentary burst of gas is entirely sufficient to eject the very lightweight confetti many feet into the air. It will also be noted that the valve is strongly biased toward the closed position by virtue of the high pressure gas acting against the relatively large surface area of valve head 48. However, if desired, additional biasing means, such as a compression spring 66 may be included in order to further assure that the valve remains closed at all times other than when trigger 60 is manually actuated. These and other variations in the details of the valve design will be apparent to those skilled in the valve art and include, for example, the valves described above which are sold by Leland Limited, Inc. of Bedminster, N.J. for use in dust and particle remover systems using $CO_2$ cartridges which are sold under the trademark POWER CLEAN.

In the foregoing embodiment, barrel 16 containing the confetti is illustrated as being connected to valve-trigger assembly 14 by a threaded connector or fitting 26 such that each barrel is screwed onto and off of the fitting to change barrels. While such a connection is simple and operates well in practice, a certain amount of time is required to change the threaded barrels, and there are occasions when it is highly desirable to be able to remove the empty barrel and replace it very quickly with another barrel preloaded with confetti. Accordingly, FIG. 3 illustrates a second embodiment of the present invention in which confetti barrel 16' is connected valve-trigger assembly 14 by a quick-disconnect coupling 70. Quick-disconnect coupling 70 comprises a male fitting 72, connected to or integral with barrel 16', and a female fitting 74 connected to valve-trigger assembly 14. Quick-disconnect couplings are commercially available elements, per se, and are further described in co-pending Application Ser. No. 08/111,608 filed 25 Aug. 1993, now U.S. Pat. No. 5,529,527, which is hereby incorporated by reference, such that they need only be described in general as they relate to the present invention.

Male fitting 72 includes reduced diameter portion 76 which is of a size and shape to be engaged by a plurality of metallic retainer balls (not illustrated) which are housed within the body of female fitting 74. Female fitting 74 includes a movable sleeve 78 with a knurled surface which may be manually slid o the left as viewed in FIG. 3 over tubular portion 80 against the force of an internal spring (not illustrated). When sleeve 78 is manually held in such left position, the retainer balls are released and move radially outwardly to permit enlarged head 82 of male fitting 72 to be inserted into female fitting 74. Male fitting 72 becomes locked therein when sleeve 78 is released and is forced to the right by the internal spring such that the retainer balls are forced inwardly by the cam action of sleeve 78. A spring-pressed seal then seals against the end of the male fitting such that the quick-disconnect coupling permits the passage of compressed gas through the female and male quick-disconnect fittings when valve 48 is opened by depressing trigger 24' with the thumb. Once barrel 16' has been discharged by several momentary openings of the valve, the empty barrel may be removed very quickly by simply sliding sleeve 78 to the left, thereby releasing male fitting 72. Female fitting 74 is then ready to receive the male fitting of a new barrel which may be preloaded with confetti. Thus, in theatrical productions having many shows per day, or whenever the user desires to reload quickly, the use of the quick-disconnect coupling enables barrels to be replaced in less than ten seconds, whereby many barrels may be loaded and discharged through the same female fitting. This removes the prior time-constraint of loading which limited the number of barrels which could be discharged at a given performance, and the quick-disconnect coupling also facilitates use of the confetti launcher by non-professionals at home parties and other festive celebrations.

With regard to the type of quick-disconnect couplings which are commercially available, it will be understood that such couplings are intended for use with fluids at very high pressures and high flowrates, and often with fluids which are corrosive, such that they are relatively large and made of heavy metal such as brass alloys. The present invention departs from such conventional couplings in that the quick-disconnect couplings of the present invention may be of the same mechanical design but are preferably composed of plastic. For example, it is preferred that the male fitting be composed of polypropylene and the female fitting be composed of high density polyurathane. It is also preferred that the outer diameter of enlarged portion 82 of the male fitting be in the order of ¼ to ⅜ of an inch, and that the complete coupling have a length in the order of ¾ to 1½ inches and preferably less than one inch so as to provide a highly compact hand-held launcher.

It should also be understood that commercially available male fittings are manufactured as individual elements with a threaded end for connection to the threaded fitting of a hose, tank, or other component. As illustrated in FIG. 3, the preferred embodiment of the present invention provides male fitting 72 as an integral portion of molded plastic barrel 16'. As such, male fitting 72 itself adds very little cost or weight to that of the molded plastic barrel 16', and the integral barrel/fitting may be sufficiently low cost to be disposable when emptied if so desired. Alternatively, male fitting 72 may be provided with a threaded end which may be received in the closed end of barrel 16' as more fully described in detail in FIGS. 6–7 of co-pending application Ser. No. 08/111,608 incorporated hereinabove, now U.S. Pat. No. 5,529.527.

A further preferred embodiment of the present invention is illustrated in FIG. 4 wherein numeral 90 generically indicates the complete confetti launcher of this embodiment. Launcher 90 includes a valve-trigger assembly 14' which may be of the same construction as previously described with respect to valve/trigger assembly 14, or it may be of different detailed construction so long as it includes a controllable on-off valve which is operated by a lever, push-button, or other trigger means positioned so as to be operated by a finger on the hand of the user grasping the handle surrounding the compressed gas cylinder 12'. However, it will be noted that in this embodiment the portion of assembly 14' which connects to the compressed gas cylinder is different from that of assembly 14 as will be further described hereinafter.

A barrel 16' loaded with confetti is connected to assembly 14' so as to be easily and readily removed and replaced by another barrel. Such removable connection may comprise the quick-disconnect coupling 70 previously described, or may comprise the threaded fitting 26 described with respect to the FIG. 1 embodiment, or may comprise other connectors known per se. As in the previous embodiments, confetti launcher 90 is powered by a compressed gas cylinder which preferably comprises a $CO_2$ cartridge. However, instead of using a 16 or 38 gram cartridge with a threaded neck as previously described, confetti launcher 90 is constructed with a hollow handle 92 of a size and shape such as to receive a 12 gram, non-threaded $CO_2$ cartridge 12'. Handle 92 includes a lower, closed end 94 which engages the bottom end of the cartridge, and includes an internally threaded upper end 96. The bottom portion of valve/trigger 14' includes a permanently connected fitting 95 which preferably comprises a flange 98 having an integral cylindrical portion 100, and the outer surface of cylindrical portion 100 is threaded to cooperate with the internal threads on the upper end 96 of handle 92. Fitting 95 also mounts a hollow needle 102 and seal 103 which are positioned so as to automatically puncture and seal $CO_2$ cartridge 12' when handle 92 is screwed upwardly over cylindrical portion 100.

Several unexpected advantages result from the features of the FIG. 4 embodiment. First, it has been discovered that, although the non-threaded 12 gram cartridge is somewhat smaller than the threaded 16 gram cartridge, this difference only results in a lighter-weight, more compact launcher since it has been discovered that the smaller cartridge has no appreciable effect in launching the confetti as previously described. That is, the smaller cartridge achieves the same 2 or 3 launches of confetti, and the smaller cartridge is substantially cheaper and more readily available to the user. In addition, it will be apparent from FIG. 4 that loading and replacing the $CO_2$ cartridge is extremely simple and safe in that the cartridge is simply dropped into hollow handle 92, and the handle is then screwed onto the threads on sleeve 100 which draw the handle and cartridge toward the valve-trigger assembly for automatic puncturing and sealing by needle 102 and seal 103. In addition, when sleeve 100 and handle 92 are made of plastic, the cooperating threads act as a second seal, and the hollow plastic handle insulates the user's hand from the $CO_2$ cartridge which may become cool upon use. Of course, other valve/trigger assemblies and hollow-handle $CO_2$ cartridge designs may be used with the present invention; however, the above-described design is preferred and is commercially available from Leland Limited, Inc. referred to hereinabove for use in POWER CLEAN systems for removing dust and particles from electronic components such as computer keyboards.

With regard to the size of the above-described embodiments in actual use, it has been determined that the combined length of handle 92 and valve/trigger assembly 14' should be in the order of 5 to 6 inches depending upon the size of the $CO_2$ cartridge. As explained above, the smaller 12 gram cartridge is preferred such that the preferred length of the handle and valve/trigger assembly is in the order of 5 inches with the preferred diameter of the handle being in the order of 1 inch. This size fits ideally in one hand and positions trigger 24 so as to be operated by the thumb of the same hand; that is, as opposed to the prior art cannons which require one hand to hold the long barrel and the other hand to pull the string attached to the one-shot trigger. With the preferred barrel length in the order of 3 to 7 inches, and the preferred loading of 1 to 4 stacks or bundles of FLUTTER FETTI confetti, it will be apparent that the present invention provides a very compact and lightweight confetti launcher which may be held in and operated by only one hand. Also, the present confetti launches provides for loading the $CO_2$ cartridge in a quick and safe manner, and provides for very quickly changing barrels. Moreover, the present invention provides for substantial reduction of the high internal pressures in the $CO_2$ cartridges by providing an on-off pressure reduction valve so as to be entirely safe for use by non-professionals, and also provides controlled discharge of the confetti in multiple discharges from each cartridge.

In addition to launching conventional confetti, streamers and wrapped bundles or unwrapped stacks of FLUTTER FETTI confetti, it has been discovered by experimentation that the present invention is extremely effective in launching partially wrapped stacks of FLUTTER FETTI confetti as shown in FIG. 5. Partially wrapped stacks of FLUTTER FETTI confetti are disclosed more fully in co-pending application Ser. No. 08/273,115 filed 11 Jul. 1994 and now Pat. No. 5,531,628 which is hereby incorporated by reference. In brief, partially wrapped stack 104 comprises a stack 106 of elongated tetragonal-shaped confetti which is surrounded by a wrapper 108 on three sides; namely, on sides 110, 112 and bottom end 114 as viewed in FIG. 5. The upper end 116 of stack 104 is not wrapped such that, upon ejection from the barrel, the partially wrapped stack remains wrapped for the first portion of its flight, but then bursts open into the hundreds of individual confetti pieces. As such, partially wrapped stacks are particularly effective in combination with the launcher of the present invention, and particularly in locations with relatively low ceilings, whereas, fully wrapped bundles are more effective for higher ceilings and for use with the larger 16 and 38 gram $CO_2$ cartridges.

Partially wrapped stacks may be formed by wrapping a strip of paper, tissue paper or plastic film about three sides of a stack of confetti, or more preferably, by forming a fully wrapped stack as disclosed in co-pending application Ser. No. 08/273,115 (now Pat. No. 5,531,628) and then tearing off the portion covering upper end 116 of the stack. This may be done at the time of manufacturing the wrapped stack, or it may be done by the user immediately prior to inserting the wrapped end 114 into the barrel. Accordingly, the present invention contemplates the sale of the launcher with a plurality of fully wrapped stacks of confetti, such as a dozen, for example, and with instructions on the preferred use of fully wrapped bundles for locations with high ceilings, or outdoors, versus the use of partially wrapped stacks, versus completely unwrapped stacks such as by removing the wrapper entirely as the user may desire for different effects.

From the foregoing description of several preferred embodiments of the present invention, it will be apparent that numerous variations will become apparent to those skilled in the art of launching confetti. Accordingly, it is to be understood that the foregoing description of several preferred embodiments is intended to be purely illustrative of the principles of the invention, rather than limiting thereof, and that the legal scope of the invention is not intended to be limited other than as expressly set forth in the following claims interpreted under the doctrine of equivalents.

What is claimed is:

1. A confetti launcher comprising in combination:

(a) a cylinder of compressed gas at high pressure;

(b) an on-off valve having an inlet and an outlet, said inlet being connected to said cylinder;

(c) trigger means for manually actuating said valve to on and off positions;

(d) a barrel filled with confetti, said barrel having first and second ends;

(e) said confetti in said barrel comprising a plurality of tetragonal pieces of confetti having lengths and widths, said pieces of confetti being aligned in at least one stack with their lengths parallel to each other and to the longitudinal axis of said barrel; and (f) quick-disconnect coupling means for rapidly connecting and disconnecting said first end of said barrel to and from said valve outlet for rapidly changing barrels after discharging the confetti therefrom by opening said valve; said quick-disconnect coupling means comprising a male fitting and a female fitting, the size and shape of said male fitting being such as to be received in and removable from said female fitting, and said female fitting being connected to said valve outlet and said male fitting being connected to said first end of said barrel.

2. The confetti launcher of claim 1 wherein said stack of confetti in said barrel is wrapped with a wrapper extending about two sides and two ends of said stack.

3. The confetti launcher of claim 1 wherein said stack of confetti in said barrel is wrapped with a wrapper extending about two sides and only one end of said stack.

4. A hand-held confetti launching system comprising in combination:

(a) a plurality of hollow barrels, each of said barrels having first and second ends and containing a large plurality of pieces of confetti;

(b) said confetti in each barrel comprising at least one stack of pieces of confetti, each of said confetti pieces having a pair of faces, and said pieces of confetti being stacked in face-to-face relationship with said faces extending parallel to the longitudinal axis of said barrel;

(c) a plurality of first connector means connected to said first ends of said barrels;

(d) a cylinder of high pressure gas;

(e) an on-off valve having an inlet and an outlet, said cylinder being connected to said valve inlet;

(f) trigger means for momentarily opening and closing said onoff valve; and (g) second connector means connected to said valve outlet, said second connector means being of a size and shape such as to readily connect to and disconnect from said first connector means for readily connecting and disconnecting each of said plurality of hollow confetti-containing barrels to said valve outlet for discharging said confetti from each of said barrels when said valve is momentarily opened by said trigger means.

5. The hand-held confetti launching system of claim 4 wherein said stack of confetti is wrapped by a wrapper, said wrapper extending around at least two sides and one end of said stack of confetti.

6. A hand-held confetti launcher of a size and shape such as to be held in and operated by one hand comprising in combination:

(a) a compressed gas cartridge;

(b) an elongated hollow handle, said hollow handle being of a diameter and length such as to receive and contain said cartridge, said cartridge having a rounded end portion and a non-threaded neck portion, said handle being closed at one end and open at the other end such as to receive said rounded end portion of said cartridge in said closed end of said handle with said non-threaded neck portion of said cartridge being adjacent said open end of said handle, said open handle end having a threaded portion;

(c) a valve-trigger assembly having inlet and outlet connectors, said inlet connector comprising a cylindrical portion having threads of a size such as to mate with said threaded portion of said handle for connecting said hollow handle and said cartridge to said inlet connector of said valve/trigger assembly;

(d) said valve/trigger assembly including sealing means for sealing said non-threaded neck portion of said cartridge and puncturing means for automatically puncturing said cartridge when said handle is connected to said inlet connector;

(e) said valve/trigger assembly including an on-off valve and trigger means for opening and closing said on-off valve and partially discharging said cartridge with each opening of said valve, said trigger means being positioned relative to said handle such as to be operated by the thumb of the user while grasping said handle with said hand;

(f) said valve/trigger assembly outlet connector comprising female quick-disconnect fitting means;

(g) a plurality of hollow barrels pre-filled with confetti;

(h) each of said hollow barrels having first and second ends;

(i) male quick-disconnect fitting means secured to said first ends of said hollow barrels for rapid connection to and removal from said female quick-disconnect fitting means after said confetti is launched from each of said barrels by momentary actuation of said trigger means by the thumb of the user holding said handle in the same hand.

7. The hand-held confetti launcher of claim 6 wherein said male quick-disconnect fitting means connected to each of said plurality of hollow barrels are composed of plastic.

8. The hand-held confetti launcher of claim 7 wherein each of said male quick-disconnect fitting means and each of said hollow barrels comprise integral plastic units.

9. The hand-held confetti launcher of claim 6 wherein said on-off valve includes pressure reduction means for substantially reducing the pressure of the gas from said compressed gas cartridge as said high pressure gas flows through said on-off valve means for creating a substantially lower and safer pressure in said hollow barrel in the order of one-half or less of the pressure in said cartridge.

* * * * *